US010789963B2

(12) United States Patent
Fuchs et al.

(10) Patent No.: US 10,789,963 B2
(45) **Date of Patent: *Sep. 29, 2020**

(54) COMFORT NOISE ADDITION FOR MODELING BACKGROUND NOISE AT LOW BIT-RATES

(71) Applicant: Fraunhofer-Gesellschaft zur Foerderung der angewandten Forschung e.V., Munich (DE)

(72) Inventors: Guillaume Fuchs, Erlangen (DE); Anthony Lombard, Erlangen (DE); Emmanuel Ravelli, Erlangen (DE); Stefan Doehla, Erlangen (DE); Jérémie Lecomte, Fuerth (DE); Martin Dietz, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/448,291

(22) Filed: Jun. 21, 2019

(65) Prior Publication Data

US 2020/0013417 A1 Jan. 9, 2020

Related U.S. Application Data

(60) Continuation of application No. 16/053,525, filed on Aug. 2, 2018, now Pat. No. 10,339,941, which is a (Continued)

(51) Int. Cl.
*G10L 19/012* (2013.01)

(52) U.S. Cl.
CPC ..... *G10L 19/012* (2013.01)

(58) Field of Classification Search
None
See application file for complete search history.

(56) References Cited

U.S. PATENT DOCUMENTS 5,537,509 A 7/1996 Swaminathan et al.
5,630,016 A 5/1997 Swaminathan et al.
(Continued)

FOREIGN PATENT DOCUMENTS

CN 101366077 A 2/2009
CN 102063905 A 5/2011
(Continued)

OTHER PUBLICATIONS

3GPP, TS 26.190, "Adaptive Multi-Rate wideband speech transcoding", 3GPP TS 26.190; 3GPP Technical Specification., Sep. 2014, pp. 1-51.
(Continued)

*Primary Examiner* — Thuykhanh Le
(74) *Attorney, Agent, or Firm* — Perkins Coie LLP; Michael A. Glenn

(57) ABSTRACT

The invention provides a decoder being configured for processing an encoded audio bitstream, wherein the decoder includes: a bitstream decoder configured to derive a decoded audio signal from the bitstream, wherein the decoded audio signal includes at least one decoded frame; a noise estimation device configured to produce a noise estimation signal containing an estimation of the level and/or the spectral shape of a noise in the decoded audio signal; a comfort noise generating device configured to derive a comfort noise signal from the noise estimation signal; and a combiner configured to combine the decoded frame of the decoded audio signal and the comfort noise signal in order to obtain an audio output signal.

26 Claims, 6 Drawing Sheets

Related U.S. Application Data division of application No. 14/744,788, filed on Jun. 19, 2015, now Pat. No. 10,147,432, which is a continuation of application No. PCT/EP2013/077527, filed on Dec. 19, 2013.

(60) Provisional application No. 61/740,883, filed on Dec. 21, 2012.

(56) References Cited

U.S. PATENT DOCUMENTS

| | | | | |
|---|---|---|---|---|
| 5,870,397 | A | 2/1999 | Chauffour et al. | |
| 5,991,716 | A | 11/1999 | Lehtimaki | |
| 6,615,169 | B1 | 9/2003 | Ojala Pasi et al. | |
| 6,873,604 | B1 | 3/2005 | Surazski et al. | |
| 7,203,638 | B2 | 4/2007 | Jelinek et al. | |
| 7,454,010 | B1 | 11/2008 | Ebenezer | |
| 8,494,846 | B2 * | 7/2013 | Dai | G10L 19/012 704/200.1 |
| 2003/0078767 | A1 * | 4/2003 | Nayak | G10L 25/78 704/200 |
| 2004/0076271 | A1 * | 4/2004 | Koistinen | G10L 19/005 379/88.11 |
| 2005/0102136 | A1 * | 5/2005 | Makinen | G10L 19/012 704/214 |
| 2005/0143989 | A1 | 6/2005 | Jelinek | |
| 2005/0267746 | A1 * | 12/2005 | Jelinek | G10L 19/173 704/226 |
| 2005/0278171 | A1 | 12/2005 | Suppappola et al. | |
| 2006/0100859 | A1 * | 5/2006 | Jelinek | G10L 19/24 704/201 |
| 2006/0265219 | A1 * | 11/2006 | Honda | G10L 21/0208 704/233 |
| 2007/0050189 | A1 * | 3/2007 | Cruz-Zeno | G10L 19/012 704/226 |
| 2007/0064681 | A1 * | 3/2007 | Boillot | H04L 43/00 370/352 |
| 2007/0110042 | A1 | 5/2007 | Li et al. | |
| 2007/0225971 | A1 * | 9/2007 | Bessette | G10L 19/265 704/203 |
| 2007/0265842 | A1 * | 11/2007 | Jarvinen | G10L 25/78 704/214 |
| 2008/0046233 | A1 * | 2/2008 | Chen | G10L 19/005 704/211 |
| 2008/0133226 | A1 * | 6/2008 | Huang | G10L 25/78 704/219 |
| 2008/0159560 | A1 | 7/2008 | Song et al. | |
| 2009/0012783 | A1 | 1/2009 | Klein | |
| 2009/0063165 | A1 * | 3/2009 | Ojala | G10L 19/012 704/500 |
| 2009/0110209 | A1 | 4/2009 | Li et al. | |
| 2009/0190527 | A1 * | 7/2009 | Marinier | H04L 1/0002 370/328 |
| 2009/0192790 | A1 * | 7/2009 | El-Maleh | G10L 21/02 704/219 |
| 2009/0222268 | A1 | 9/2009 | Li et al. | |
| 2009/0306992 | A1 * | 12/2009 | Ragot | G10L 19/26 704/500 |
| 2009/0323982 | A1 | 12/2009 | Solbach et al. | |
| 2010/0088092 | A1 * | 4/2010 | Bruhn | G10L 19/06 704/228 |
| 2010/0198590 | A1 * | 8/2010 | Tackin | H04L 12/6418 704/214 |
| 2010/0318352 | A1 | 12/2010 | Taddei et al. | |
| 2010/0324917 | A1 * | 12/2010 | Shlomot | G10L 19/012 704/501 |
| 2011/0093276 | A1 * | 4/2011 | Ramo | G10L 19/008 704/500 |
| 2011/0235500 | A1 * | 9/2011 | Shenoi | H04J 3/0632 370/201 |
| 2011/0238425 | A1 * | 9/2011 | Neuendorf | G10L 19/18 704/500 |
| 2012/0101813 | A1 | 4/2012 | Vaillancourt et al. | |
| 2012/0237048 | A1 * | 9/2012 | Barron | H04B 3/23 381/71.1 |
| 2012/0271644 | A1 * | 10/2012 | Bessette | G10L 19/03 704/500 |
| 2013/0304464 | A1 * | 11/2013 | Wang | G10L 19/0208 704/233 |
| 2013/0332176 | A1 | 12/2013 | Setiawan et al. | |
| 2014/0122065 | A1 | 5/2014 | Daimon et al. | |
| 2014/0376744 | A1 * | 12/2014 | Hetherington | H03G 3/20 381/94.2 |
| 2015/0243299 | A1 * | 8/2015 | Sehlstedt | G10L 25/78 704/226 |

FOREIGN PATENT DOCUMENTS

| | | | |
|---|---|---|---|
| CN | 102136271 | A | 7/2011 |
| CN | 102667927 | A | 9/2012 |
| EP | 665530 | B1 | 8/2000 |
| EP | 1154408 | A2 | 11/2001 |
| EP | 1229520 | A2 | 8/2002 |
| EP | 1224659 | B1 | 5/2005 |
| EP | 1998319 | B1 | 8/2010 |
| EP | 2936486 | B1 | 7/2018 |
| JP | 3252782 | B2 | 1/1998 |
| JP | H11205485 | A | 7/1999 |
| JP | 2003522964 | A | 7/2003 |
| JP | 2004077961 | A | 3/2004 |
| JP | 2005114890 | A | 4/2005 |
| JP | 2007065636 | A | 3/2007 |
| JP | 2010532879 | A | 10/2010 |
| JP | 2011516901 | A | 5/2011 |
| KR | 1020050049538 | A | 5/2005 |
| KR | 1020080042153 | A | 5/2008 |
| RU | 2237296 | C2 | 9/2004 |
| RU | 2325707 | C2 | 5/2008 |
| RU | 2461898 | C2 | 9/2012 |
| WO | 9957715 | A1 | 11/1999 |
| WO | 02101724 | A1 | 12/2002 |
| WO | 2002101724 | | 12/2002 |
| WO | 2006136901 | A2 | 12/2006 |
| WO | 2007027291 | A1 | 3/2007 |
| WO | 2009097020 | A1 | 8/2009 |
| WO | 2010003618 | A2 | 1/2010 |
| WO | 2010040522 | A2 | 4/2010 |
| WO | 2010148516 | A1 | 12/2010 |
| WO | 2011049515 | A1 | 4/2011 |
| WO | 2012055016 | A1 | 5/2012 |
| WO | 2012110482 | A2 | 8/2012 |
| WO | 2014096279 | A1 | 6/2014 |
| WO | 2014096280 | A1 | 6/2014 |

OTHER PUBLICATIONS

Benyassine, Adit et al., "ITU-T Recommendation G. 729 Annex B: A Silence Compression Scheme for Use with G. 729 Optimized for V. 70 Digital Simultaneous Voice and Data Applications", Communications Magazine, IEEE 35.9, Sep. 1997, pp. 64-73.

ITU-T, G.718, "Frame error robust narrow-band and wideband embedded variable bit-rate coding of speech and audio from 8-32 kbit/s", Recommendation ITU-T G.718, Jun. 2008, 257 pages.

Lombard, Anthony et al., "Frequency-Domain Comfort Noise Generation for Discontinuous Transmission in EVS", Acoustics, Speech and Signal Processing (ICASSP), 2015 IEEE International Conference on IEEE, Apr. 2015, pp. 5893-5897.

* cited by examiner

COMFORT NOISE ADDITION FOR MODELING BACKGROUND NOISE AT LOW BIT-RATES

CROSS-REFERENCE TO RELATED APPLICATIONS

This application is a continuation of copending U.S. patent application Ser. No. 16/053,525, which is a divisional of copending U.S. patent application Ser. No. 14/744,788, filed Dec. 19, 2013, which is a continuation of copending International Application No. PCT/EP2013/077527, filed Dec. 19, 2013, which is incorporated herein by reference in its entirety, and additionally claims priority from U.S. Application No. 61/740,883, filed Dec. 21, 2012, which is incorporated herein by reference in its entirety

BACKGROUND OF THE INVENTION

The present invention relates to audio signal processing, and, in particular, to noisy speech coding and comfort noise addition to audio signals.

Comfort noise generators are usually used in discontinuous transmission (DTX) of audio signals, in particular of audio signals containing speech. In such a mode the audio signal is first classified in active and inactive frames by a voice activity detector (VAD). An example of a VAD can be found in [1]. Based on the VAD result, only the active speech frames are coded and transmitted at the nominal bit-rate. During long pauses, where only the background noise is present, the bit-rate is lowered or zeroed and the background noise is coded episodically and parametrically. The average bit-rate is then significantly reduced. The noise is generated during the inactive frames at the decoder side by a comfort noise generator (CNG). For example the speech coders AMR-WB [2] and ITU G.718 [1] have the possibility to be run both in DTX mode.

The coding of speech and especially of noisy speech at low bit-rates is prone to artefacts. Speech coders are usually based on a speech production model which doesn't hold anymore in presence of background noise. In that case, the coding efficiently drops and the quality of decoded audio signal decreases. Moreover certain characteristics of speech coding may be especially perturbing when handling noisy speech. Indeed at low rates, the coarse quantization of coding parameters produces some fluctuation over time, fluctuations perceptually annoying when coding speech over stationary background noise.

Noise reduction is a well-known technique for enhancing the intelligibility of speech and improving the communication in the presence of background noise. It was also adopted in speech coding. For example the coder G.718 uses noise reduction for deducing some coding parameters like the speech pitch. It has also the possibility to code the enhanced signal instead of the original signal. The speech is then more predominant compared to the noise level in the decoded signal. However, it usually sounds more degraded or less natural, as noise reduction might distort the speech components and cause audible musical noise artifacts in addition to the coding artifacts.

SUMMARY

According to an embodiment, a decoder being configured for processing an encoded audio bitstream may have: a bitstream decoder configured to derive a decoded audio signal from the bitstream, wherein the decoded audio signal includes at least one decoded frame; a noise estimation device configured to produce a noise estimation signal containing an estimation of the level and/or the spectral shape of a noise in the decoded audio signal; a comfort noise generating device configured to derive a comfort noise signal from the noise estimation signal; and a combiner configured to combine the decoded frame of the decoded audio signal and the comfort noise signal in order to obtain an audio output signal.

According to another embodiment, an encoder being configured for producing an audio bitstream may have: a bitstream encoder configured to produce an encoded audio signal corresponding to an audio input signal and to derive the bitstream from the encoded audio signal; an signal analyzer having a signal-to-noise ratio estimator configured to determine the signal-to-noise ratio of the audio input signal based on an energy of a wanted signal of the audio input signal determined by a wanted signal energy estimator and based on an energy of a noise of the audio input signal determined by noise energy estimator; a noise reduction device configured to produce a noise reduced audio signal; and a switch device configured to feed, depending on the determined signal-to-noise ratio of the audio input signal, either the audio input signal or the noise reduced audio signal to the bitstream encoder for the purpose of encoding the respective signal, wherein the bitstream encoder is configured to transmit a side information, which indicates whether the audio input signal or the noise reduced audio signal is encoded, within in the bitstream.

An embodiment may have a system including a decoder and an encoder, wherein the decoder is designed in an inventive way and/or the encoder is being configured for producing an audio bitstream, the encoder including: a bitstream encoder configured to produce an encoded audio signal corresponding to an audio input signal and to derive the bitstream from the encoded audio signal; an signal analyzer having a signal-to-noise ratio estimator configured to determine the signal-to-noise ratio of the audio input signal based on an energy of a wanted signal of the audio input signal determined by a wanted signal energy estimator and based on an energy of a noise of the audio input signal determined by noise energy estimator; a noise reduction device configured to produce a noise reduced audio signal; and a switch device configured to feed, depending on the determined signal-to-noise ratio of the audio input signal, either the audio input signal or the noise reduced audio signal to the bitstream encoder for the purpose of encoding the respective signal, wherein the bitstream encoder is configured to transmit a side information, which indicates whether the audio input signal or the noise reduced audio signal is encoded, within in the bitstream.

According to an embodiment, a method of decoding an audio bitstream may have the steps of: deriving a decoded audio signal from the bitstream, wherein the decoded audio signal includes at least one decoded frame; producing a noise estimation signal containing an estimation of the level and/or the spectral shape of a noise in the decoded audio signal; deriving a comfort noise signal from the noise estimation signal; and combining the decoded frame of the decoded audio signal and the comfort noise signal in order to obtain an audio output signal.

According to another embodiment, a method of audio signal encoding for producing an audio bitstream may have the steps of: determining the signal-to-noise ratio of an audio input signal based on a determined energy of a wanted signal of the audio input signal and a determined energy of a noise of the audio input signal; producing an noise reduced audio signal; producing an encoded audio signal corresponding to the audio input signal, wherein, depending on the determined signal-to-noise ratio of the audio input signal, either the audio input signal or the noise reduced audio signal is encoded; deriving the bitstream from the encoded audio signal; and transmitting a side information, which indicates whether the audio input signal or the noise reduced audio signal is encoded, within the bitstream.

An embodiment may have a bitstream produced according to the inventive method of audio signal encoding.

According to an embodiment, a non-transitory digital storage medium may have a computer program stored thereon to perform the method of decoding an audio bitstream, wherein the method includes: deriving a decoded audio signal from the bitstream, wherein the decoded audio signal includes at least one decoded frame; producing a noise estimation signal containing an estimation of the level and/or the spectral shape of a noise in the decoded audio signal; deriving a comfort noise signal from the noise estimation signal; and combining the decoded frame of the decoded audio signal and the comfort noise signal in order to obtain an audio output signal, when said computer program is run by a computer.

According to another embodiment, a non-transitory digital storage medium may have a computer program stored thereon to perform the method of audio signal encoding for producing an audio bitstream, wherein the method includes: determining the signal-to-noise ratio of an audio input signal based on a determined energy of a wanted signal of the audio input signal and a determined energy of a noise of the audio input signal; producing an noise reduced audio signal; producing an encoded audio signal corresponding to the audio input signal, wherein, depending on the determined signal-to-noise ratio of the audio input signal, either the audio input signal or the noise reduced audio signal is encoded; deriving the bitstream from the encoded audio signal; and transmitting a side information, which indicates whether the audio input signal or the noise reduced audio signal is encoded, within the bitstream, when said computer program is run by a computer.

In one aspect the invention provides a decoder being configured for processing an encoded audio bitstream, wherein the decoder comprises: a bitstream decoder configured to derive a decoded audio signal from the bitstream, wherein the decoded audio signal comprises at least one decoded frame; a noise estimation device configured to produce a noise estimation signal containing an estimation of the level and/or the spectral shape of a noise in the decoded audio signal; a comfort noise generating device configured to derive a comfort noise signal from the noise estimation signal; and a combiner configured to combine the decoded frame of the decoded audio signal and the comfort noise signal in order to obtain an audio output signal.

The bitstream decoder may be a device or a computer program capable of decoding an audio bitstream, which is a digital data stream containing audio information. The decoding process results in a digital decoded audio signal, which may be fed to an A/D converter to produce an analogous audio signal, which then may be fed to a loudspeaker, in order to produce an audible signal.

The decoded audio signal is divided into so called frames, wherein each of these frames contains audio information referring to a certain time interval. Such frames may be classified into active frames and inactive frames, wherein an active frame is a frame, which contains wanted components of the audio information, such as speech or music, whereas an inactive frame is a frame, which does not contain any wanted components of the audio information. Inactive frames usually occur during pauses, where no wanted components, such as music or speech, are present. Therefore, inactive frames usually contain solely background noise.

In discontinuous transmission (DTX) of audio signal only the active frames of the decoded audio signal are obtained by decoding the bitstream as during inactive frames the encoder does not transmit the audio signal within the bitstream.

In non-discontinuous transmission (non-DTX) of audio signal the active frames as well as the inactive frames are obtained by decoding the bitstream.

Frames which are obtained by decoding the bitstream by the bitstream decoder are referred to as decoded frames The noise estimation device is configured to produce a noise estimation signal containing an estimation of the level and/or the spectral shape of a noise in the decoded audio signal. Further, the comfort noise generating device is configured to derive a comfort noise signal from the noise estimation signal. The noise estimation signal may be a signal, which contains information regarding the characteristics of the noise contained in the decoded audio signal in a parametric form. The comfort noise signal is an artificial audio signal, which corresponds to the noise contained in the decoded audio signal. These features allow the comfort noise to sound like the actual background noise without necessitating any side information regarding the background noise in the bitstream.

The combiner is configured to combine the decoded frame of the decoded audio signal and the comfort noise signal in order to obtain an audio output signal. As a result the audio output signal comprises decoded frames, which comprise artificial noise. The artificial noise in the decoded frames allows masking artifacts in the audio output signal especially when the bitstream is transmitted at low bit-rates. It smooths the usually observed fluctuations and in the meantime masks the predominant coding artifacts.

In contrast to conventional technology, the present invention applies the principle of adding artificial comfort noise to decoded frames. The inventive concept may be applied in both DTX and non-DTX modes.

The invention provides a method for enhancing the quality of noisy speech coded and transmitted at low bit-rates. At low bit-rates, the coding of noisy speech, i.e. speech recorded with background noise, is usually not as efficient as the coding of clean speech. The decoded synthesis is usually prone to artifacts. The two different kinds of sources, the noise and the speech, can't be efficiently coded by a coding scheme relying on a single-source model. The present invention provides a concept for modeling and synthesizing the background noise at the decoder side and necessitates very small or no side-information. This is achieved by estimating the level and spectral shape of the background noise at the decoder side, and by generating artificially a comfort noise. The generated noise is combined with the decoded audio signal and allows masking coding artifacts.

Furthermore, the concept can be combined with a noise reduction scheme applied at the encoder side. Noise reduction enhances the signal-to-noise ratio (SNR) level, and improves the performance of the subsequent audio coding. The missing amount of noise in the decoded audio signal is then compensated by the comfort noise at the decoder side. However, it usually sounds more degraded or less natural, as noise reduction might distort the audio components and cause audible musical noise artifacts in addition to the coding artifacts. One aspect of the present invention is to mask such unpleasant distortions by adding a comfort noise at the decoder side. When using a noise reduction scheme, the addition of comfort noise does not deteriorate the SNR. Moreover, the comfort noise conceals a great part of the annoying musical noise typical to noise reduction techniques.

In an embodiment of the invention the decoded frame is an active frame. This feature extends the principle of comfort noise addition to decoded active frames.

In an embodiment of the invention the decoded frame is an active frame. This feature extends the principle of comfort noise addition to decoded inactive frames.

In an embodiment of the invention the noise estimating device comprises a spectral analysis device configured to create an analysis signal containing the level and the spectral shape of the noise in the decoded audio signal and a noise estimation producing device configured to produce the noise estimation signal based on the analysis signal.

In an embodiment of the invention the comfort noise generating device comprises a noise generator configured to create a frequency domain comfort noise signal based on the noise estimation signal and a spectral synthesizer configured to create the comfort noise signal based on the frequency domain comfort noise signal.

In an embodiment of the invention the decoder comprises a switch device configured to switch the decoder alternatively to a first mode of operation or to a second mode of operation, wherein in the first mode of operation the comfort noise signal is fed to the combiner, whereas the comfort noise signal is not fed to the combiner in the second mode of operation. These features allow to cease the use of the artificial comfort noise in situations, where it is not needed.

In an embodiment of the invention the decoder comprises a control device configured to control the switch device automatically, wherein the control device comprises a noise detector configured to control the switch device depending on a signal-to-noise ratio of the decoded audio signal, wherein under low-signal-to-noise-ratio-conditions the decoder is switched to the first mode of operation and under high-signal-to-noise-ratio-conditions to the second mode of operation. By these features the comfort noise may be triggered in noisy speech scenarios only, i.e., not in clean speech or clean music situations. For the purpose of discriminating between low-signal-to-noise-ratio-conditions and high-signal-to-noise-ratio-conditions a threshold for the signal-to-noise ratio may be defined and used.

In an embodiment of the invention the control device comprises a side information receiver configured to receive side information contained in the bitstream, which corresponds to the signal-to-noise ratio of the decoded audio signal, and configured to create a noise detection signal, wherein the noise detector controls the switch device depending on the noise detection signal. These features allow controlling the switch device based on a signal analysis done by an external device producing and/or processing the received bitstream. The external device especially may be an encoder producing the bitstream.

In an embodiment of the invention the side information corresponding to the signal-to-noise ratio of the decoded audio signal consists of at least one dedicated bit in the bitstream. A dedicated bit in general is a bit, which contains, alone or together with other dedicated bits, defined information. Here, the dedicated bit may indicate, if the signal-to-noise ratio is above or below a predefined threshold.

In an embodiment of the invention the control device comprises a wanted signal energy estimator configured to determine an energy of a wanted signal of the decoded audio signal, a noise energy estimator configured to determine an energy of a noise of the decoded audio signal and a signal-to-noise ratio estimator configured to determine the signal-to-noise ratio of the decoded audio signal based on the energy of wanted signal and based on the energy of the noise, wherein the switch device is switched depending on the signal-to-noise ratio determined by the control device. In this case no side information in the bitstream is necessitated. As the energy of the wanted signal usually exceeds the energy of the noise of the decoded signal, the total energy of the decoded audio signal, including the energy of the wanted signal as well as the energy of the noise, gives a rough estimation of the energy of the wanted signal of the decoded audio signal. For this reason, the signal-to-noise ratio may be calculated in an approximation by dividing the total energy of the decoded audio signal by the energy of the noise of the decoded signal.

In an embodiment of the invention the bitstream contains active frames and inactive frames, wherein the control device is configured to determine the energy of the wanted signal of the decoded audio signal during the active frames and to determine the energy of the noise of the decoded audio signal during inactive frames. By this, a high accuracy in estimating the signal-to-noise ratio may be achieved in an easy way.

In an embodiment of the invention the bitstream contains active frames and inactive frames, wherein the decoder comprises a side information receiver configured to discriminate between the active frames and the inactive frames based on side information in the bitstream indicating whether the present frame is active or inactive. By this feature active frames or in active frames respectively may be identified without calculating effort.

In an embodiment of the invention the side information indicating whether the present frame is active or inactive consists of at least one dedicated bit in the bitstream.

In an embodiment of the invention the control device is configured to determine the energy of the wanted signal of the decoded audio signal based on the analysis signal. In this case the analysis signal, which usually has to be computed for the purpose of noise estimation, may be reused, so that the complexity may be reduced.

In an embodiment of the invention the control device is configured to determine the energy of the noise of the decoded audio signal based on the noise estimation signal. In such an embodiment the noise estimation signal, which typically has to be computed for the purpose of comfort noise generating, may be reused, so that the complexity may be further reduced.

In an embodiment of the invention the comfort noise generating device is configured to create the comfort noise signal based on a target comfort noise level signal. The level of added comfort noise should be limited to preserve intelligibility and quality. This may be achieved by scaling the comfort noise using a target noise signal which indicates a pre-determined target noise level.

In an embodiment of the invention the target comfort noise level signal is adjusted depending on a bit-rate of the bitstream. Typically, the decoded audio signal exhibits a higher signal-to-noise ratio than the original input signal, especially at low bit-rates where the coding artifacts are the most severe. This attenuation of the noise level in speech coding is coming from the source model paradigm which expects to have speech as input. Otherwise, the source model coding is not entirely appropriate and won't be able to reproduce the whole energy of non-speech components. Hence, the target comfort noise level signal may be adjusted depending on the bit-rate to roughly compensate for the noise attenuation inherently introduced by coding process.

In an embodiment of the invention the target comfort noise level signal is adjusted depending on a noise attenuation level caused by a noise reduction method applied to the bitstream. By this features the noise attenuation caused by a noise reduction module in an encoder may be compensated.

In an embodiment of the invention an energy of the frequency domain comfort noise signal of the random noise w(k) is adjusted depending on the target comfort noise level signal, which indicates a target comfort noise level $g_{tar}$, for each frequency k as $E_w(k)=\max\{(g_{tar}-1)\hat{E}_n(k); 0\}$, wherein $\hat{E}_n(k)$ refers to an estimate of the energy of the noise of the decoded audio signal at frequency k, as delivered by the noise estimation producing device. By these features intelligibility and quality of the output signal may be enhanced.

In an embodiment of the invention the decoder comprises a further bitstream decoder, wherein the bitstream decoder and the further bitstream decoder are of different types, wherein the decoder comprises a switch configured to feed either the decoded signal from the bitstream decoder or the decoded signal from the further bitstream decoder to the noise estimation device and to the combiner. As the comfort noise addition is done when using the bitstream decoder as well as when using the further bitstream decoder, transition artefacts when switching between the bitstream decoder and the further bitstream decoder may be minimized. For example, the bitstream decoder may be an algebraic code excited linear prediction (ACELP) bitstream decoder, whereas the further bitstream decoder may be a transform-based core (TCX) bitstream decoder.

The invention further provides an audio signal processing encoder being configured for producing an audio bitstream, wherein the encoder comprises: a bitstream encoder configured to produce an encoded audio signal corresponding to an audio input signal and to derive the bitstream from the encoded audio signal; an signal analyzer having a signal-to-noise ratio estimator configured to determine the signal-to-noise ratio of the audio input signal based on an energy of a wanted signal of the audio signal determined by a wanted signal energy estimator and based on an energy of a noise of the audio input signal determined by noise energy estimator; a noise reduction device configured to produce an noise reduced audio signal; and a switch device configured to feed, depending on the determined signal-to-noise ratio of the audio input signal, either the audio input signal or the noise reduced audio signal to the bitstream encoder for the purpose of encoding the respective signal, wherein the bitstream encoder is configured to transmit a side information, which indicates whether the audio input signal or noise reduced audio signal is encoded, within in the bitstream.

The bitstream encoder may be a device or a computer program capable of encoding an audio signal, which is a digital data signal containing audio information. The encoding process results in a digital bitstream, which may be transmitted over a digital data link to a decoder at a remote location.

The audio input signal is directly coded by the bitstream encoder. The bitstream encoder can be a speech encoder or a low-delay scheme switching between a speech coder ACELP and a transform-based audio coder TCX. The bitstream encoder is responsible for coding the audio input signal and generating the bitstream needed for decoding the audio signal. In parallel, the input signal is analyzed by any module called signal analyzer. In an embodiment the signal analysis is the same as the one used in G.718. It consists of a spectral analysis device followed by the noise estimation producing device. The spectrums of both the original signal and the estimated noise are input in the noise reduction module.

The noise reduction attenuates the background noise level in the frequency domain. The amount of reduction is given by the target attenuation level. The enhanced time-domain signal (noise reduced audio signal) is generated after spectral synthesis. The signal is used for deducing some features, like the pitch stability which is then exploited by the VAD for discriminating between active and inactive frames. The result of the classification can be further used by the encoder module. In the embodiment, a specific coding mode is used to handle inactive frames. This way, the decoder can deduce the VAD flag from the bit-stream without necessitating a dedicated bit.

To avoid unnecessitated distortions in noiseless situations (clean speech or clean music), noise reduction is applied only in case of noisy speech and is bypassed otherwise. The discrimination between noisy and noiseless signals is achieved by estimating the long-term energy of both the noise and the desired signal (speech or music). The long-term energy is computed by a first-order auto-regressive filtering of either the input frame energy (during active frames) or using the output of the noise estimation module (during inactive frames). In this way an estimate of the signal-to-noise ratio can be computed, which is defined as the ratio of the long-term energy of the speech or music over the long-term energy of the noise.

If the signal-to-noise ratio is below a predetermined threshold, the frame is considered as noisy speech otherwise it is classified as clean speech. As the bitstream encoder is configured to transmit within in the bitstream side information, which indicates whether the audio input signal or noise reduced audio signal is encoded, the decoder may adjust the target comfort noise level signal automatically to the mode of operation of the encoder.

In the embodiment of the invention during active frames, only the long-term speech/music energy estimate is updated. During inactive frames, only the noise energy estimate is updated.

The invention further provides a system comprising an audio signal processing decoder and an audio signal processing encoder, wherein the decoder is designed according to the claimed invention and/or the encoder is designed according to the claimed invention.

In another aspect the invention provides a method of decoding an audio bitstream, wherein the method comprises: deriving a decoded audio signal from the bitstream, wherein the decoded audio signal comprises at least one decoded frame; producing a noise estimation signal containing an estimation of the level and/or the spectral shape of a noise in the decoded audio signal; deriving a comfort noise signal from the noise estimation signal; and combining the decoded frame of the decoded audio signal and the comfort noise signal in order to obtain an audio output signal.

The invention further provides a method of audio signal encoding for producing an audio bitstream, wherein the method comprises: determining the signal-to-noise ratio of an audio input signal based on a determined energy of a wanted signal of the audio input signal and a determined energy of a noise of the audio input signal; producing an noise reduced audio signal; producing an encoded audio signal corresponding to the audio input signal, wherein, depending on the determined signal-to-noise ratio of the audio input signal, either the audio input signal or the noise reduced audio signal is encoded; deriving the bitstream from the encoded audio signal; and transmitting a side information, which indicates whether the audio input signal or the noise reduced audio signal is encoded, within the bitstream.

The invention further provides a bitstream produced according to the method above. The claimed bitstream contains side information, which indicates whether the audio input signal or the noise reduced audio signal is encoded.

A further aspect the invention provides a computer program for performing, when running on a computer or a processor, the inventive methods.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
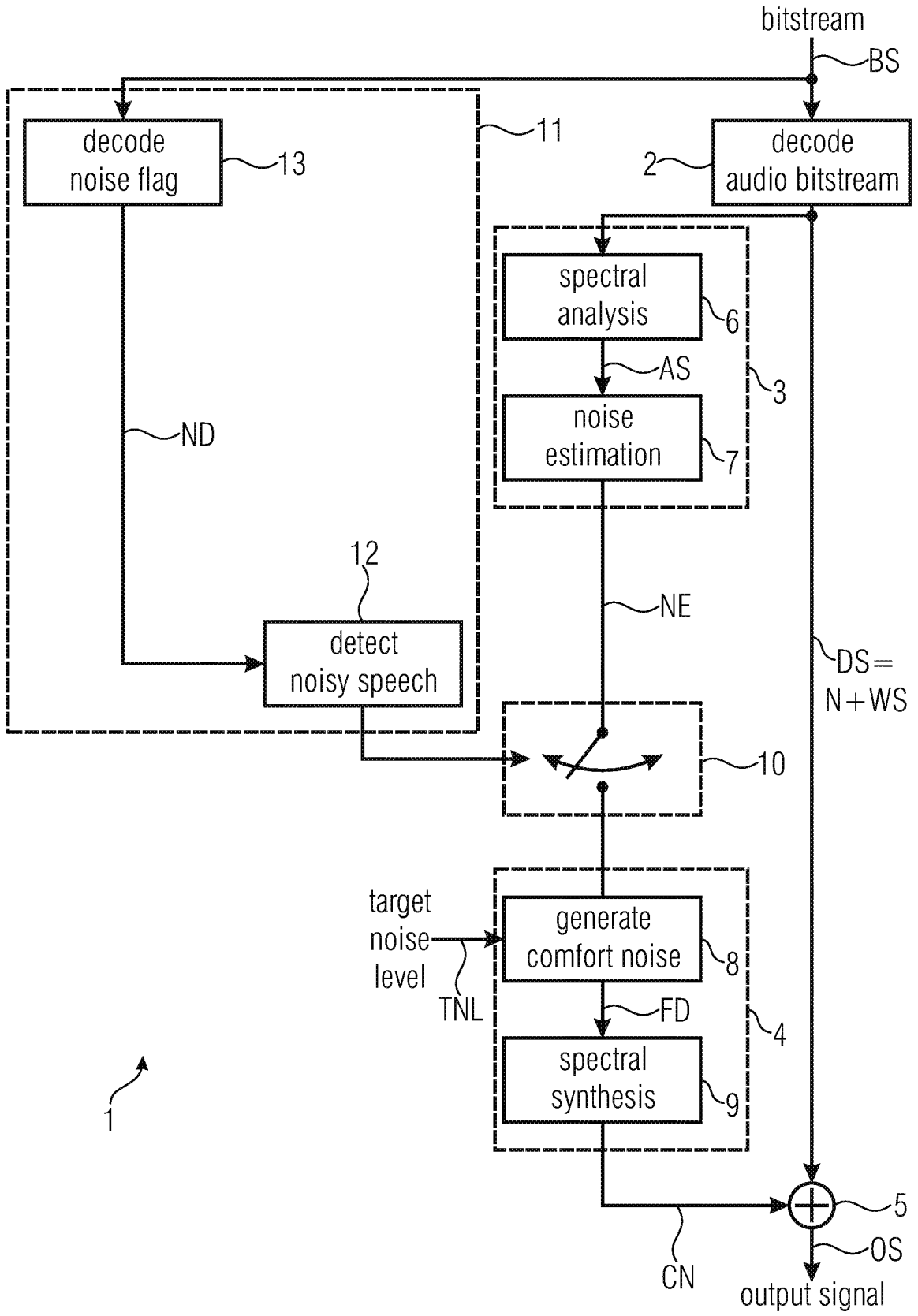
FIG. 1 illustrates a first embodiment of a decoder according to the invention.

FIG. 1 illustrates a first embodiment of a decoder 1 according to the invention. The decoder 1 is configured for processing an encoded audio bitstream BS, wherein the decoder 1 comprises: a bitstream decoder 2 configured to derive a decoded audio signal DS from the bitstream BS, wherein the decoded audio signal DS comprises at least one decoded frame; a noise estimation device 3 configured to produce a noise estimation signal NE containing an estimation of the level and/or the spectral shape of a noise N in the decoded audio signal DS; a comfort noise generating device 4 configured to derive a comfort noise audio signal CN from the noise estimation signal NE; and a combiner 5 configured to combine the decoded frame of the decoded audio signal DS and the comfort noise signal CN in order to obtain an audio output signal OS.

The bitstream decoder 2 may be a device or a computer program capable of decoding an audio bitstream BS, which is a digital data stream containing audio information. The decoding process results in a digital decoded audio signal DS, which may be fed to an A/D converter to produce an analogous audio signal, which then may be fed to a loudspeaker, in order to produce an audible signal.

The decoded audio signal DS comprises so called frames, wherein each of these frames contains audio information referring to a certain time. Such frames may be classified into active frames and inactive frames, wherein an active frame is a frame, which contains wanted components WS of the audio information, also referred to as wanted signal WS, such as speech or music, whereas an inactive frame is a frame, which does not contain any wanted components of the audio information. Inactive frames usually occur during pauses, where no wanted components, such as music or speech, are present. Therefore, inactive frames usually contain solely background noise N.

The noise estimation device 3 is configured to produce a noise estimation signal NE containing an estimation of the level and/or the spectral shape of a noise in the decoded audio signal DS. Further, the comfort noise generating device 4 is configured to derive a comfort noise audio signal CN from the noise estimation signal NE. The noise estimation signal NE may be a signal, which contains information regarding the characteristics of the noise N contained in the decoded audio signal DS in a parametric form. The comfort noise signal CN is an artificial audio signal, which corresponds to the noise N contained in the decoded audio signal DS. These features allow the comfort noise CN to sound like the actual background noise N without necessitating any side information in the bitstream BS regarding the background noise N.

The combiner 5 is configured to combine the decoded frame of the decoded audio signal DS and the comfort noise signal CN in order to obtain an audio output signal OS. As a result the audio output signal OS comprises decoded frames, which comprise artificial noise CN. The artificial noise CN in the decoded frames allows masking artifacts in the audio output signal OS especially when the bitstream BS is transmitted at low bit-rates.

In contrast to conventional technology, the present invention applies the principle of adding artificial comfort noise CN to decoded active or non-active frames. The inventive concept may be applied in both DTX and non-DTX modes.

The invention provides a method for enhancing the quality of noisy speech coded and transmitted at low bit-rates. At low bit-rates, the coding of noisy speech, i.e. speech recorded with background noise N, is usually not as efficient as the coding of clean speech WS. The decoded synthesis is usually prone to artifacts. The two different kinds of sources, the noise N and the speech WS, can't be efficiently coded by a coding scheme relying on a single-source model. The present invention provides a concept for modeling and synthesizing the background noise N at the decoder side and necessitates very small or no side-information. This is achieved by estimating the level and spectral shape of the background noise N at the decoder side, and by generating artificially a comfort noise CN. The generated noise CN is combined with the decoded audio signal DS and allows masking coding artifacts during decoded frames.

Furthermore, the concept can be combined with a noise reduction scheme applied at the encoder side. Noise reduction enhances the signal-to-noise ratio (SNR) level, and improves the performance of the subsequent audio coding. The missing amount of noise N in the decoded audio signal DS is then compensated by the comfort noise CN at the decoder side. However, it usually sounds more degraded or less natural, as noise reduction might distort the audio components and cause audible musical noise artifacts in addition to the coding artifacts. One aspect of the present invention is to mask such unpleasant distortions by adding a comfort noise CN at the decoder side. When using a noise reduction scheme, the addition of comfort noise does not deteriorate the SNR. Moreover, the comfort noise conceals a great part of the annoying musical noise typical to noise reduction techniques.

In an embodiment of the invention the decoded frame is an active frame. This feature extends the principle of comfort noise addition to decoded active frames.

In an embodiment of the invention the decoded frame is an active frame. This feature extends the principle of comfort noise addition to decoded inactive frames.

In an embodiment of the invention the noise estimating device 3 comprises a spectral analysis device 6 configured to create an analysis signal AS containing the level and the spectral shape of the noise in the decoded audio signal DS and a noise estimation producing device 7 configured to produce the noise estimation signal NE based on the analysis signal AS.

In an embodiment of the invention the comfort noise generating device comprises 4 a noise generator 8 configured to create a frequency domain comfort noise signal FD based on the noise estimation signal NE and a spectral synthesizer 9 configured to create the comfort noise CN signal based on the frequency domain comfort noise signal FD.

In an embodiment of the invention the decoder 1 comprises a switch device 10 configured to switch the decoder 1 alternatively to a first mode of operation or to a second mode of operation, wherein in the first mode of operation the comfort noise signal CN is fed to the combiner, whereas the comfort noise signal CN is not fed to the combiner 5 in the second mode of operation. These features allow to cease the use of the artificial comfort noise CN in situations, where it is not needed.

In an embodiment of the invention the decoder 1 comprises a control device 11 configured to control the switch device 10 automatically, wherein the control device 10 comprises a noise detector 12 configured to control the switch device 10 depending on a signal-to-noise ratio of the decoded audio signal DS, wherein under low-signal-to-noise-ratio-conditions the decoder is switched to the first mode of operation and under high-signal-to-noise-ratio-conditions to the second mode of operation. By these features the use of comfort noise CN may be triggered in noisy speech scenarios only, i.e., not in clean speech or clean music situations. For the purpose of discriminating between low-signal-to-noise-ratio-conditions and high-signal-to-noise-ratio-conditions a threshold for the signal-to-noise ratio may be defined and used.

In an embodiment of the invention the control device 11 comprises a side information receiver 13 configured to receive side information contained in the bitstream BS, which corresponds to the signal-to-noise ratio of the decoded audio signal DS, and configured to create a noise detection signal ND, wherein the noise detector 12 switches the switch device 11 depending on the noise detection signal ND. These features allow to control the switch device 10 based on a signal analysis done by an external device producing and/or processing the received bitstream BS. The external device especially may be an encoder producing the bitstream BS.

In an embodiment of the invention the side information corresponding to the signal-to-noise ratio of the decoded audio signal DS consists of at least one dedicated bit in the bitstream BS. A dedicated bit in general is a bit, which contains, alone or together with other dedicated bits, defined information. Here, the dedicated bit may indicate, if the signal-to-noise ratio is above or below a predefined threshold.

In an embodiment of the invention the comfort noise generating device 4 is configured to create the comfort noise signal CN based on a target comfort noise level signal TNL. The level of added comfort noise CN should be limited to preserve intelligibility and quality. This may be achieved by scaling the comfort noise CN using a target noise signal TNL which indicates a pre-determined target noise level.

In an embodiment of the invention the target comfort noise level signal TNL is adjusted depending on a bit-rate of the bitstream BS. Typically, the decoded audio signal DS exhibits a higher signal-to-noise ratio than the original input signal, especially at low bit-rates where the coding artifacts are the most severe. This attenuation of the noise level in speech coding is coming from the source model paradigm which expects to have speech as input. Otherwise, the source model coding is not entirely appropriate and won't be able to reproduce the whole energy of no-speech components. Hence, the target comfort noise level signal TNL may be adjusted depending on the bit-rate to roughly compensate for the noise attenuation inherently introduced by coding process.

In an embodiment of the invention the target comfort noise level signal TNL is adjusted depending on a noise attenuation level caused by a noise reduction method applied to the bitstream BS. By this features the noise attenuation caused by a noise reduction module in an encoder may be compensated.

In an embodiment of the invention an energy of the frequency domain comfort noise signal FD of the random noise w(k) is adjusted depending on the target comfort noise level signal TNL, which indicates a target comfort noise level $g_{tar}$, for each frequency k as $E_w(k)=\max\{(g_{tar}-1)\hat{E}_n(k); 0\}$, wherein $\hat{E}_n(k)$ refers to an estimate of the energy of the noise N of the decoded audio signal DS at frequency k, as delivered by the noise estimation producing device 7. By these features intelligibility and quality of the output signal OS may be enhanced.

Figure 2:
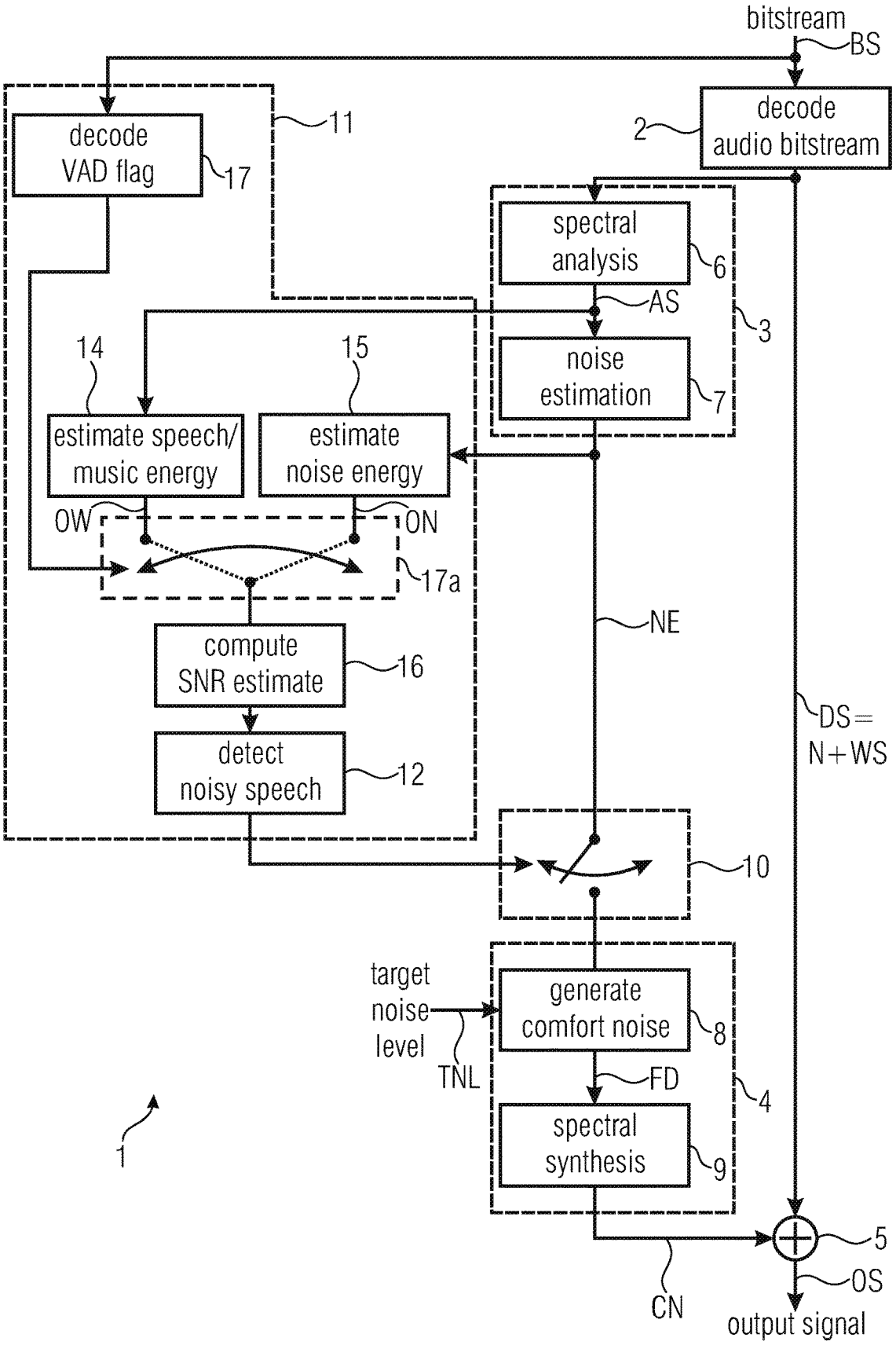
FIG. 2 illustrates a second embodiment of a decoder according to the invention.

FIG. 2 illustrates a second embodiment of a decoder 1 according to the invention.

The second embodiment of the decoder 1 is based on the decoder 1 of the first embodiment. In the following only the differences to the first embodiment discussed and explained.

In an embodiment of the invention the control device comprises a wanted signal energy estimator 14 configured to determine an energy of a wanted signal WS of the decoded audio signal DS, a noise energy estimator 15 configured to determine an energy of a noise N of the decoded audio signal DS and a signal-to-noise ratio estimator 16 configured to determine the signal-to-noise ratio of the decoded audio signal DS based on the energy of wanted signal WS and based on the energy of the noise N, wherein the switch device 10 is switched depending on the signal-to-noise ratio determined by the control device 11. In this case no side information in the bitstream regarding the signal-to-noise ratio is necessitated. Therefore, the side information receiver 13 of the first embodiment is not necessitated as well.

In an embodiment of the invention the bitstream BS contains active frames and inactive frames, wherein the control device 11 is configured to determine the energy of the wanted signal WS of the decoded audio signal DS during the active frames and to determine the energy of the noise N of the decoded audio signal DS during inactive frames. By this, a high accuracy in estimating the signal-to-noise ratio may be achieved in an easy way.

In an embodiment of the invention the bitstream BS contains active frames and inactive frames, wherein the decoder 1 comprises a side information receiver 17 configured to discriminate between the active frames and the inactive frames based on side information in the bitstream indicating whether the present frame is active or inactive. By this feature active frames or in active frames respectively may be identified without calculating effort.

In the embodiment of the invention the side information receiver 17 may be configured to control and a switch 17*a*, which alternatively feeds an output signal OW of the wanted signal energy estimator 14 or an output signal ON of the noise energy estimator 15 to the signal-to-noise ratio estimator 16, wherein the output signal OW of a wanted signal energy estimator 14 is fed to the to the signal-to-noise ratio estimator 16 during active frames and wherein the output signal ON of the noise energy estimate of 15 is fed to the to the signal-to-noise ratio estimator 16 during inactive frames. By these features the signal-to-noise ratio may be calculated in an easy and accurate manner.

In an embodiment of the invention the control device 11 is configured to determine the energy of the wanted signal of the decoded audio signal based on the analysis signal AS. In this case the analysis signal AS, which usually has to be computed for the purpose of noise estimation, may be reused, so that the complexity may be reduced.

In an embodiment of the invention the control device 11 is configured to determine the energy of the noise N of the decoded audio signal DS based on the noise estimation signal NE. In such an embodiment the noise estimation signal NE, which typically has to be computed for the purpose of comfort noise generating, may be reused, so that the complexity may be further reduced.

In an embodiment of the invention the decoder 1 comprises a further bitstream decoder (not shown in the figures), wherein the bitstream decoder 2 and the further bitstream decoder are of different types, wherein the decoder 1 comprises a switch (not shown in the figures) configured to feed either the decoded signal DS from the bitstream decoder 2 or the decoded signal from the further bitstream decoder to the noise estimation device 3 and to the combiner 5. As the comfort noise addition is done when using the bitstream decoder 2 as well as when using the further bitstream decoder, transition artefacts when switching between the bitstream decoder 2 and the further bitstream decoder may be minimized. For example, the bitstream decoder 2 may be an algebraic code excited linear prediction (ACELP) bitstream decoder, whereas the further bitstream decoder may be a transform-based core (TCX) bitstream decoder.

The decoder 1 of the invention is described in FIGS. 1 and 2, where the comfort noise addition is done blindly in the frequency domain. To have a comfort noise CN which looks like the actual background noise N, a noise estimation device 3 is used at the decoder 1 to determine the level and spectral shape of the background noise N, without necessitating any side-information.

The comfort noise generating device 4 is triggered in noisy speech scenarios only, i.e., not in clean speech or clean music situations. The discrimination can be based on the detection performed in the encoder. In this case, the decision should be transmitted using a dedicated bit. In an embodiment, in contrast, a noise estimation producing device 7 is applied which is similar to the noise estimation device used in the encoder. It consists in estimating the long-term signal-to noise ratio by separately adapting long-term estimates of either the energy of the noise N or the energy of the wanted signal WS, such as speech and/or music, depending on the VAD decision. The latter may be deduced directly from the index of the ACELP and TCX modes. Indeed, TCX and ACELP can be run in a specific mode called TCX-NA and ACELP-NA, respectively, when the signal is non-active speech/music frames, i.e., frames with background noise only. All other modes of ACELP and TCX refer to active frames. Hence the presence of a dedicated VAD bit in the bit-stream can be avoided.

The level of added comfort noise should be limited to preserve intelligibility and quality. The comfort noise is hence scaled to reach a pre-determined target noise level. If $g_{tar}$ denotes the target noise amplification level after comfort noise addition, the energy $E_w$ of the random noise w(k) is adjusted for each frequency k as $$E_w(k)=\max\{(g_{tar}-1)\hat{E}_n(k);\ 0\},$$

where $\hat{E}_n(k)$ refers to an estimate of the noise energy present in the decoded audio output at frequency k, as delivered by the noise estimation module.

Typically, the decoded audio signal DS exhibits a higher signal-to-noise ratio than the original input signal, especially at low bit-rates where the coding artifacts are the most severe. This attenuation of the noise level in speech coding is coming from the source model paradigm which expects to have speech as input. Otherwise, the source model coding is not entirely appropriate and won't be able to reproduce the whole energy of no-speech components. Hence, for the first aspect of the invention using the encoder depicted in FIG. 3, the target comfort noise level $g_{tar}$ is adjusted depending on the bit-rate to roughly compensate for the noise attenuation inherently introduced by coding process.

Figure 4:
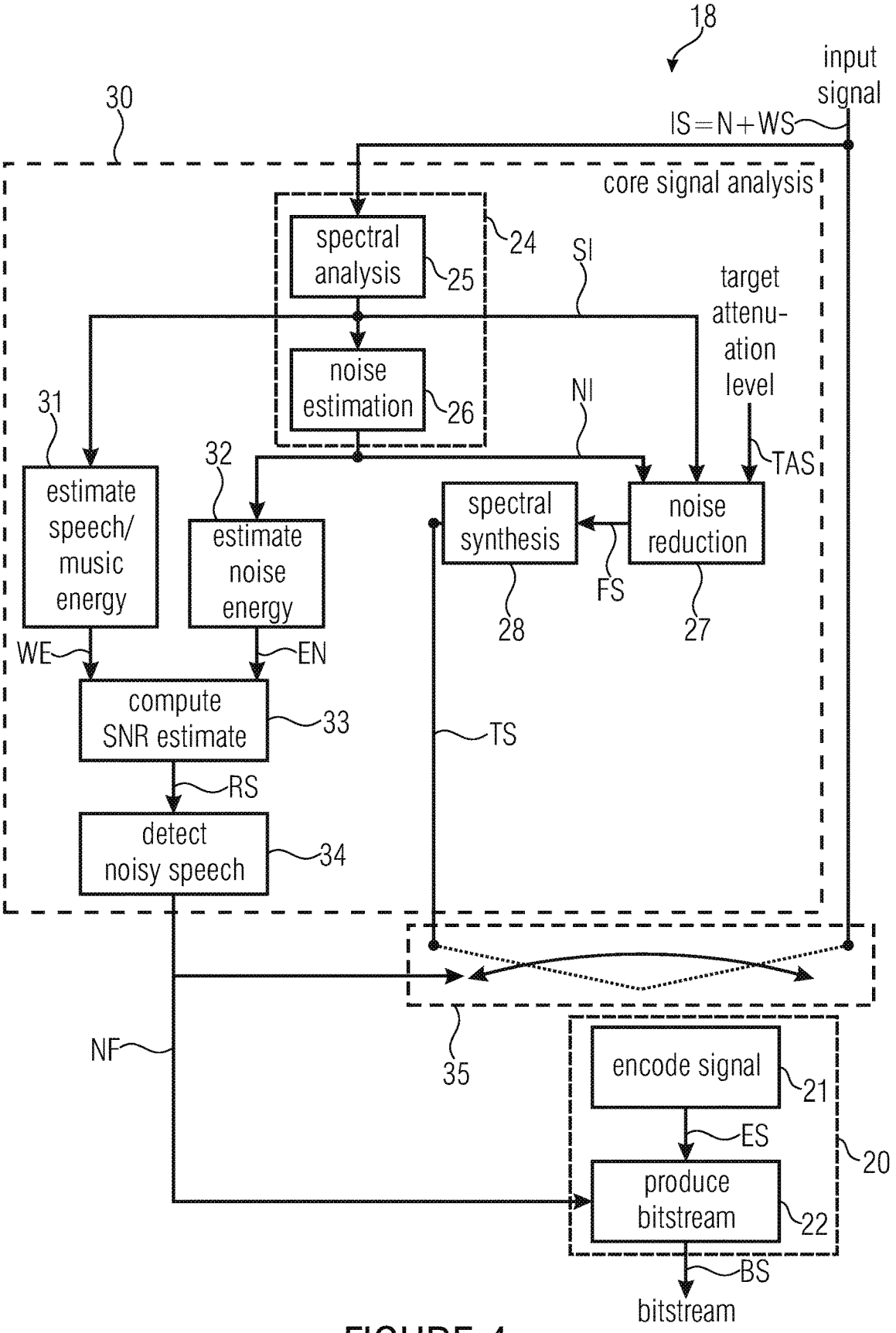
FIG. 4 illustrates a first embodiment of an encoder according to the invention.
Figure 5:
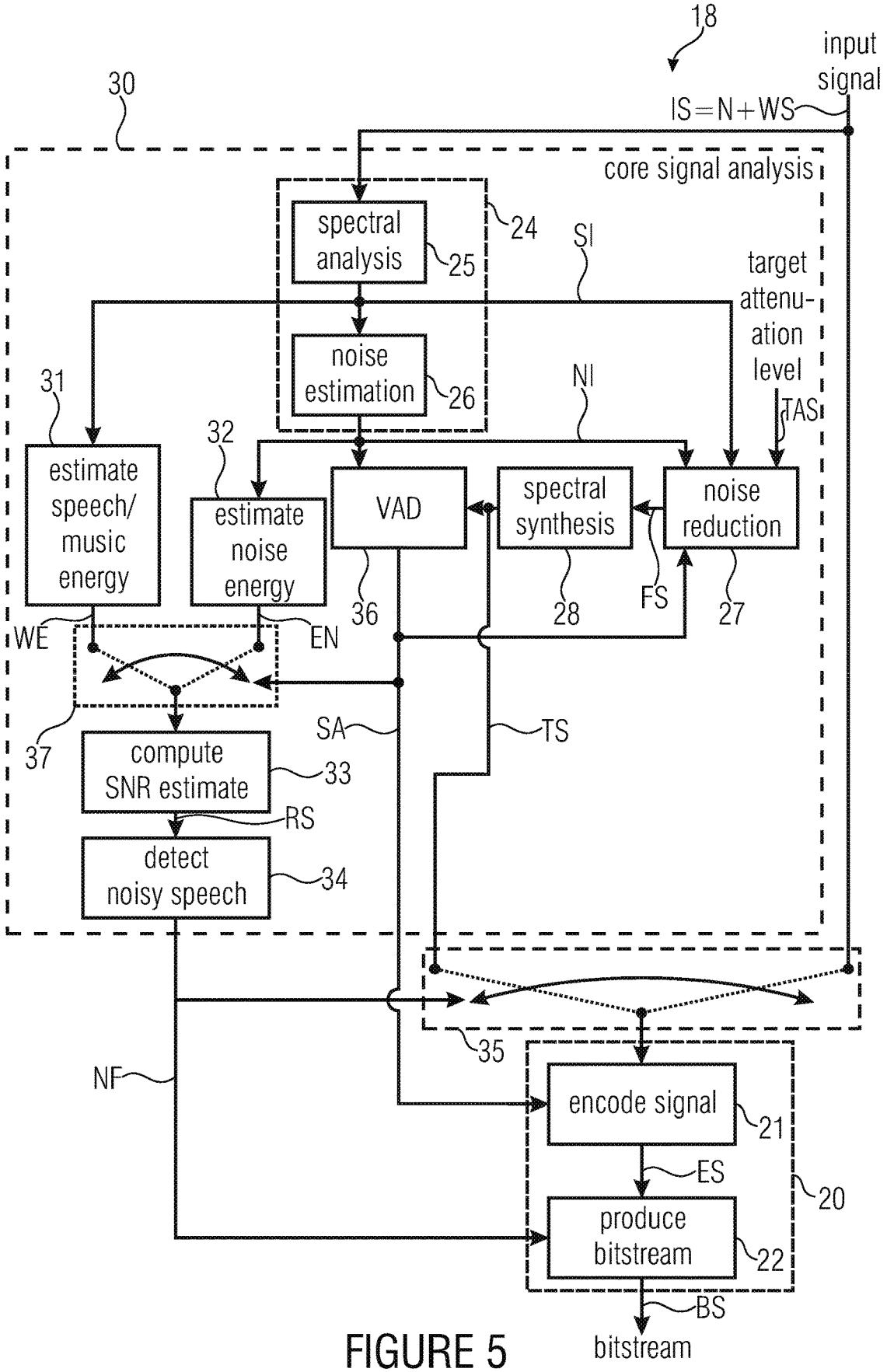
FIG. 5 illustrates a second embodiment of an encoder according to the invention.

For the second aspect of the invention using the encoder depicted in FIGS. 4 and 5, the target comfort noise level $g_{tar}$ should, in addition, account for the noise attenuation caused by the noise reduction module in the encoder.

Furthermore, the comfort noise addition as described herein allows to smooth the transition artefact between one coding type (e.g.) to another one (e.g. TCX) by adding uniformly a comfort noise over all frames.

Figure 3:
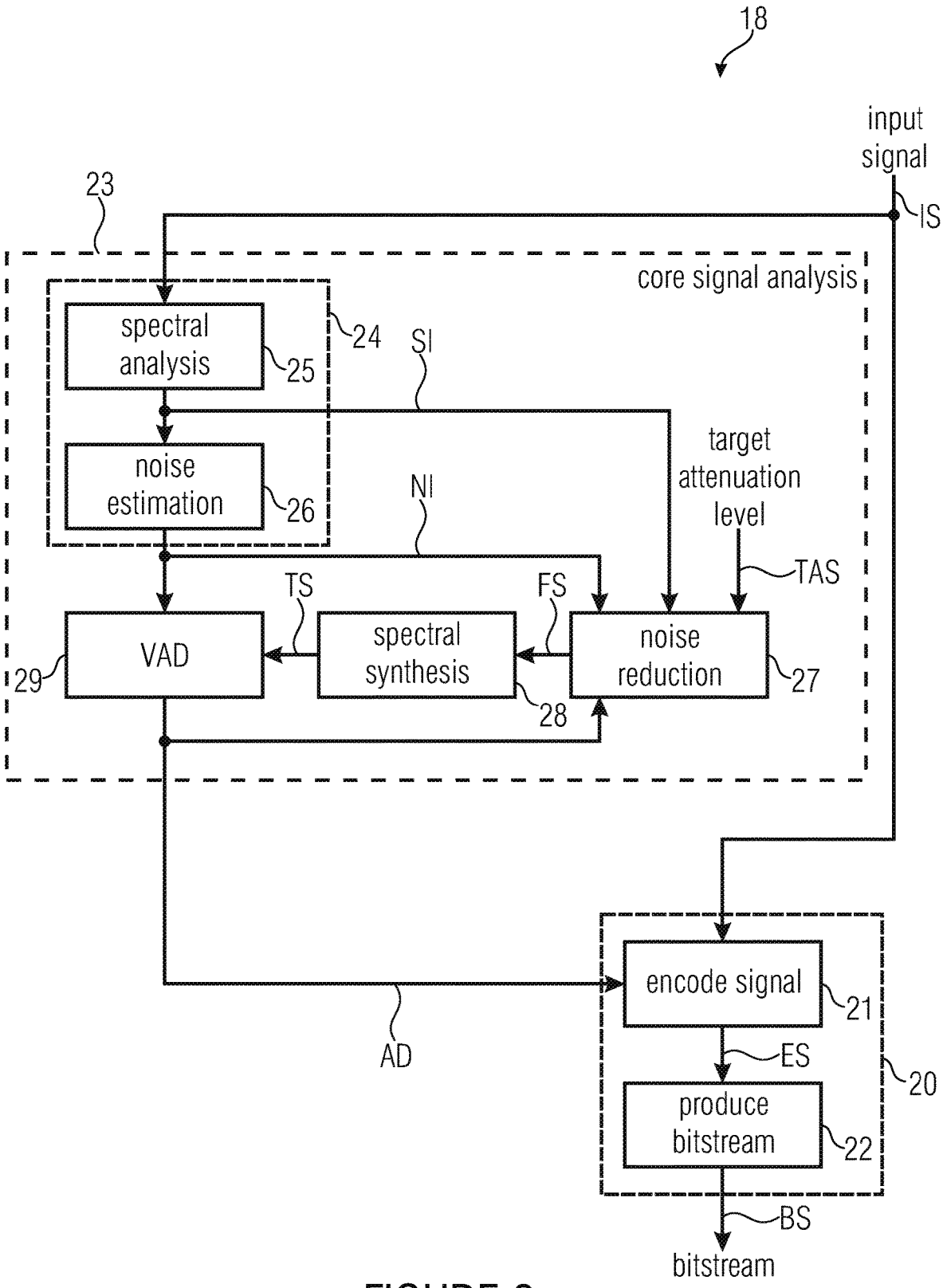
FIGURE 3 (PRIOR ART)
FIG. 3 illustrates an encoder according to conventional technology.

FIG. 3 illustrates an encoder according to conventional technology which can be used in combination with the decoders depicted in FIGS. 1 and 2.

The input signal IS is directly coded by the bitstream encoder 20. The bitstream encoder 20 can be a speech coder or a low-delay scheme switching between a speech coder ACELP and a transform-based audio coder TCX. The bitstream encoder 20 comprises a signal encoder 21 for coding the signal IS and a bit stream producer 22 for generating the bitstream BS needed for producing the decoded signal DS at the decoder 1. In parallel, the input signal IS is analyzed by the module called signal analyzer 23, which comprises a noise estimation device 24. In the embodiment the noise estimation device 24 is the same as the one used in G.718. It consists of a spectral analysis device 25 followed by a noise estimation producing device 26. The spectrum SI of the original signal IS and the spectrum NI of the estimated noise are input in the noise reduction module 27. The noise reduction module 27 is attenuates the background noise level in the enhanced frequency domain signal FS. The amount of reduction is given by the target attenuation level signal TAS. The enhanced time-domain signal (noise reduced audio signal) is TS is generated after spectral synthesis done by the spectral synthesis device 28. The signal TS is used for deducing some features, like the pitch stability which is then exploited by the signal activity detector 29 for discriminating between active and inactive frames. The result of the classification can be further used by the encoder module 18. In an embodiment, a specific coding mode is used to handle inactive frames. This way, the decoder 1 can deduce the signal activity flag (VAD flag) from the bit-stream without necessitating a dedicated bit.

FIG. 4 illustrates a first embodiment of an encoder 18 according to the invention. The encoder 18 depicted in FIG. 4 is based on the encoder 18 shown in FIG. 3.

The encoder 18 shown in FIG. 4 is configured for producing an audio bitstream BS, wherein the encoder 18 comprises: a bitstream encoder 20 configured to produce an encoded audio signal ES corresponding to an audio input signal IS and to derive the bitstream BS from the encoded audio signal ES; an signal analyzer 19 having a signal-to-noise ratio estimator 33 configured to determine the signal-to-noise ratio of the audio input signal IS based on an energy of a wanted signal WS of the audio input signal IS determined by a wanted signal energy estimator 31 and based on an energy of a noise N of the audio input signal IS determined by noise energy estimator 32; a noise reduction device 27, 28 configured to produce a noise reduced audio signal TS; and a switch device 35 configured to feed, depending on the determined signal-to-noise ratio of the audio input signal IS, either the audio input signal IS or the noise reduced audio signal TS to the bitstream encoder 20 for the purpose of encoding the respective signal IS, TS, wherein the bitstream encoder 20 is configured to transmit a side information within in the bitstream, which indicates whether the audio input signal IS or the noise reduced audio signal TS is encoded.

The bitstream encoder 20 may be a device or a computer program capable of encoding an audio signal, which is a digital data signal containing audio information. The encoding process results in a digital bitstream, which may be transmitted over a digital data link to a decoder at a remote location.

The encoder part of one embodiment of the invention is given in FIG. 4. The main difference compared to FIG. 3 is coming from the fact that this time it encodes the output of the noise reduction, i.e., the enhanced signal TS. To avoid unnecessitated distortions in noiseless situations (clean speech or clean music), noise reduction is applied only in case of noisy speech and is bypassed otherwise. The discrimination between noisy and noiseless signals is achieved by estimating the long-term energy of the wanted signal WS (speech or music) by the wanted signal energy estimator 31 and by estimating the long-term energy of the noise N by the noise energy estimator 32. For this purpose the wanted signal energy estimator 31 receives the spectrum SI signal for the input signal IS as provided by the spectral analysis device 25. Further, the noise energy estimator receives the noise estimation signal NI for the input signal IS as provided by the noise estimation producing device 26. During active frames, only the long-term speech/music energy estimate WE is updated. During inactive frames, only the noise energy estimate NE is updated. The long-term energy is computed by a first-order auto-regressive filtering of either the input frame energy (during active frames) or using the output of the noise estimation module (during inactive frames). In this way a signal-to-noise ratio signal RS can be computed by the signal-to-noise ratio estimator 33, which contains the ratio of the long-term energy of the speech or music WS over the long-term energy of the noise N. The signal-to-noise ratio signal RS is fed to a noise detector 34 which determines whether the present frame contains a noisy audio signal or a clean audio signal If the signal-to-noise ratio signal RS is below a predetermined threshold, the frame is considered as noisy speech otherwise it is classified as clean speech.

The result of the classification is outputted as a noise flag signal NF, which is used to control the switch 35. Furthermore, the noise takes signal NF is fed to the bitstream encoder 20. The bitstream encoder 20 is configured to produce and to transmit a side information based on the noise flag signal NF within in the bitstream, which indicates whether the audio input signal IS or the noise reduced audio signal TS is encoded. By decoding this flag a decoder may adjust the target noise level automatically without the necessity of classifying the decoded signal DS as being a noisy or as being clean.

FIG. 5 illustrates a second embodiment of an encoder 18 according to the invention. The encoder 18 depicted in FIG. 5 is based on the encoder a team shown in FIG. 4. In the following additional features be explained. In FIG. 4 the signal analyzer 30 comprises a signal activity detector 36 which receives the spectrum signal SI for the input signal IS and the noise estimation signal NI. The signal activity detector 36 is configured to discriminate between active frames and inactive frames based on these two signals. The signal activity detector produces a signal activity signal SA which on one hand is transmitted to the bitstream encoder 20 for the purpose of adapting the bitstream BS to the signal activity and on the other hand is used to switch a switch 37 which is configured to alternatively fed the wanted signal energy signal WE or the noise energy signal EN two the signal-to-noise ratio estimator 33.

Figure 6:
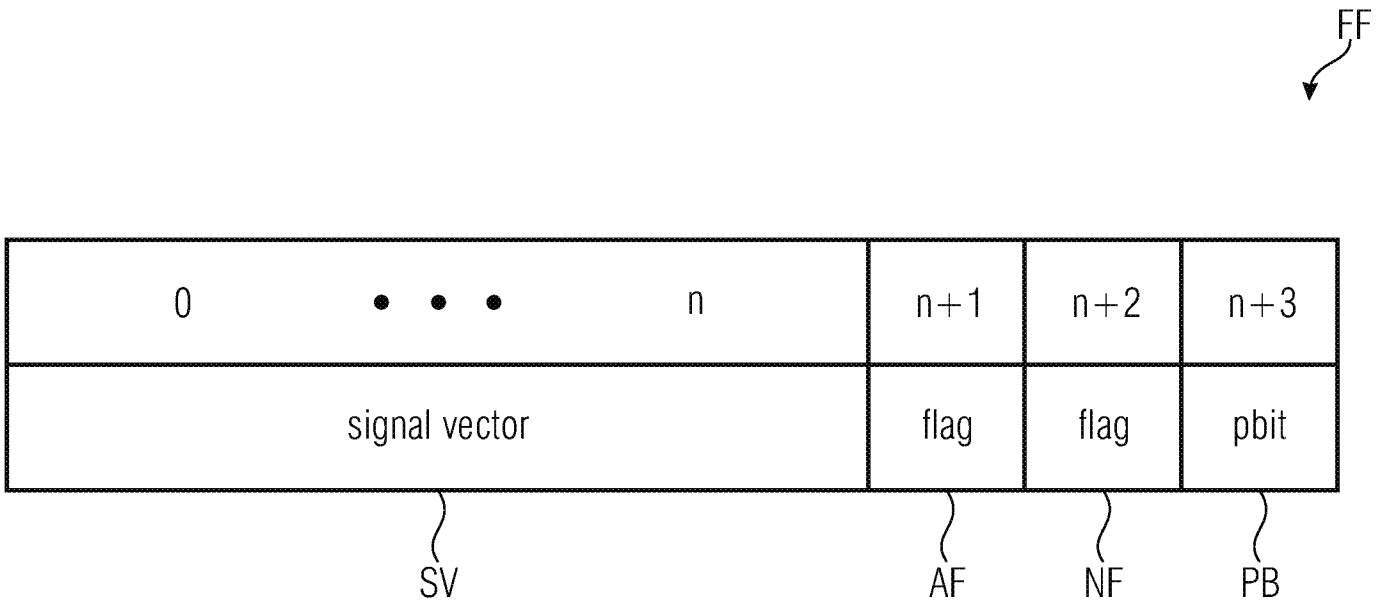
FIG. 6 illustrates an embodiment of a frame format of the bitstream according to the invention.

FIG. 6 illustrates an embodiment of a frame format FF of the bitstream BS according to the invention. The frame according to the frame format FF comprises a signal vector SV having a plurality of bits which are located on the positions from 0 to n. At the position n+1 a bit being an activity flag AF indicating whether the frame is in active frame and inactive frame is located. Furthermore, the position n+2 a bit being a noise flag NF indicating whether the frame contains a noisy signals or a team signal is foreseen. At the position n+3 and bit being padding bit PB is arranged.

In an embodiment of the invention the side information indicating whether the present frame is active or inactive consists of at least one dedicated bit in the bitstream.

As a summary it may be said that in one aspect of the invention, the original signal is encoded and at decoder 1 it is decoded before being added to an artificially generated comfort noise CN. The comfort noise generating device 4 necessitates no or very small amount of side-information. In a first embodiment, the comfort noise generating device 4 necessitates no side-information and all the processing is done blindly. In the embodiment, the comfort noise generating device 4 needs to recover the VAD information (active and inactive frame classification result) from the bit-stream BS, which can be already present in the bit-stream and used for other purposes. In a third embodiment, the comfort noise generating device 4 necessitates from the encoder 18 a noisy speech flag discriminating between clean and noisy speech. One can also imagine any kinds of information parametrically coded which can help to drive the comfort noise generating device 4.

In another aspect of the invention, noise reduction is first applied to the original signal IS and an enhanced signal TS is conveyed to the bitstream encoder 20, coded, and transmitted. At the end of the decoding, an artificially-generated comfort noise CN is then added to the decoded (enhanced) signal DS. The target attenuation level used for noise reduction at the encoder is a static value shared with the CNG module at the decoder. Hence, the target attenuation level does not need to be explicitly transmitted.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a non-transitory storage medium such as a digital storage medium, for example a floppy disc, a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the invention method is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver .

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] Recommendation ITU-T G.718: "Frame error robust narrow-band and wideband embedded variable bit-rate coding of speech and audio from 8-32 kbit/s"

[2] 3GPP TS 26.190 "Adaptive Multi-Rate wideband speech transcoding," 3*GPP Technical Specification.*

The invention claimed is:

1. A decoder being configured for processing an encoded audio bitstream, wherein the decoder comprises:

a bitstream decoder configured to derive a decoded audio signal from the bitstream, wherein the decoded audio signal comprises at least one decoded frame;

a noise estimation device configured to produce a noise estimation signal comprising an estimation of a level and/or a spectral shape of a noise in the decoded audio signal;

a comfort noise generating device configured to derive a comfort noise signal from the noise estimation signal; and a combiner configured to combine the decoded frame of the decoded audio signal and the comfort noise signal in order to acquire an audio output signal;

wherein the decoder comprises a further bitstream decoder, wherein the bitstream decoder and the further bitstream decoder are of different types, wherein the decoder comprises a switch configured to feed either the decoded signal from the bitstream decoder or the decoded signal from the further bitstream decoder to the noise estimation device and to the combiner.

2. The decoder according to claim 1, wherein the decoded frame is an active frame.

3. The decoder according to claim 1, wherein the decoded frame is an active frame.

4. The decoder according to claim 1, wherein the noise estimating device comprises a spectral analysis device configured to create an analysis signal comprising the level and the spectral shape of the noise in the decoded audio signal and a noise estimation producing device configured to produce the noise estimation signal based on the analysis signal.

5. The decoder according to claim 1, wherein the comfort noise generating device comprises a noise generator configured to create a frequency domain comfort noise signal based on the noise estimation signal and a spectral synthesizer configured to create the comfort noise signal based on the frequency domain comfort noise signal.

6. The decoder according to claim 1, wherein the decoder comprises a switch device configured to switch the decoder alternatively to a first mode of operation or to a second mode of operation, wherein in the first mode of operation the comfort noise signal is fed to the combiner, whereas the comfort noise signal is not fed to the combiner in the second mode of operation.

7. The decoder according to claim 6, wherein the decoder comprises a control device configured to control the switch device automatically, wherein the control device comprises a noise detector and configured to control the switch device depending on a signal-to-noise ratio of the decoded audio signal, wherein under low-signal-to-noise-ratio-conditions the decoder is switched to the first mode of operation and under high-signal-to-noise-ratio-conditions to the second mode of operation.

8. The decoder according claim 7, wherein the control device comprises a side information receiver configured to receive side information comprised in the bitstream, which corresponds to the signal-to-noise ratio of the decoded audio signal, and configured to create a noise detection signal, wherein the noise detector switches the switch device depending on the noise detection signal.

9. The decoder according to claim 8, wherein the side information corresponding to the signal-to-noise ratio of the decoded audio signal comprises at least one dedicated bit in the bitstream.

10. The decoder according to claim 7, wherein the control device comprises a wanted signal energy estimator configured to determine an energy of a wanted signal of the decoded audio signal, a noise energy estimator configured to determine an energy of a noise of the decoded audio signal and a signal-to-noise ratio estimator configured to determine the signal-to-noise ratio of the decoded audio signal based on the energy of wanted signal and based on the energy of the noise, wherein the switch device is switched depending on the signal-to-noise ratio determined by the control device.

11. The decoder according to claim 10, wherein the noise estimating device comprises a spectral analysis device configured to create an analysis signal comprising the level and the spectral shape of the noise in the decoded audio signal and a noise estimation producing device configured to produce the noise estimation signal based on the analysis signal, wherein the control device is configured to determine the energy of the wanted signal of the decoded audio signal based on the analysis signal.

12. The decoder according to claim 7, wherein the bitstream comprises active frames and inactive frames, wherein the control device is configured to determine the energy of the wanted signal of the decoded audio signal during the active frames and to determine the energy of the noise of the decoded audio signal during inactive frames.

13. The decoder according to claim 7, wherein the control device is configured to determine the energy of the noise of the decoded audio signal based on the noise estimation signal.

14. The decoder according to claim 13, wherein the target comfort noise level signal is adjusted depending on a noise attenuation level caused by a noise reduction method applied to the bitstream.

15. The decoder according to claim 1, wherein the bitstream comprises active frames and inactive frames, wherein the decoder comprises a side information receiver configured to discriminate between the active frames and the inactive frames based on side information in the bitstream indicating whether the present frame is active or inactive.

16. The decoder according to claim 15, wherein the side information indicating whether the present frame is active or inactive comprises at least one dedicated bit in the bitstream.

17. The decoder according to claim 1, wherein the comfort noise generating device is configured to create the comfort noise signal based on a target comfort noise level signal.

18. The decoder according to claim 17, wherein the target comfort noise level signal is adjusted depending on a bit-rate of the bitstream.

19. The decoder according to claim 17, wherein an energy $E_W(k)$ of a frequency band k of the frequency domain comfort noise signal is adjusted depending on the target comfort noise level signal, which indicates a target comfort noise level $g_{tar}$, for each frequency band k as $E_W(k) = \max\{(g_{tar}-1), \hat{E}_n(k);0\}$, wherein $\hat{E}_n k)$ refers to an estimate of the energy of the noise of the decoded audio signal at the frequency band k, as delivered by the noise estimation producing device.

20. An encoder being configured for producing an audio bitstream, wherein the encoder comprises:

a bitstream encoder configured to produce an encoded audio signal corresponding to an audio input signal and to derive the bitstream from the encoded audio signal;

an signal analyzer having a signal-to-noise ratio estimator configured to determine the signal-to-noise ratio of the audio input signal based on an energy of a wanted signal of the audio input signal determined by a wanted signal energy estimator and based on an energy of a noise of the audio input signal determined by noise energy estimator;

a noise reduction device configured to produce a noise reduced audio signal; and a switch device configured to feed, depending on the determined signal-to-noise ratio of the audio input signal, either the audio input signal or the noise reduced audio signal to the bitstream encoder for the purpose of encoding the respective signal, wherein the bitstream encoder is configured to transmit a side information, which indicates whether the audio input signal or the noise reduced audio signal is encoded, within in the bitstream.

21. A system comprising a decoder and an encoder, wherein the decoder is adapted according to claim 1 and/or the encoder is being configured for producing an audio bitstream, wherein the encoder comprises:

a bitstream encoder configured to produce an encoded audio signal corresponding to an audio input signal and to derive the bitstream from the encoded audio signal;

an signal analyzer having a signal-to-noise ratio estimator configured to determine the signal-to-noise ratio of the audio input signal based on an energy of a wanted signal of the audio input signal determined by a wanted signal energy estimator and based on an energy of a noise of the audio input signal determined by noise energy estimator;

a noise reduction device configured to produce a noise reduced audio signal; and a switch device configured to feed, depending on the determined signal-to-noise ratio of the audio input signal, either the audio input signal or the noise reduced audio signal to the bitstream encoder for the purpose of encoding the respective signal, wherein the bitstream encoder is configured to transmit a side information, which indicates whether the audio input signal or the noise reduced audio signal is encoded, within in the bitstream.

22. A method of decoding an audio bitstream, wherein the method comprises:

deriving a decoded audio signal from the bitstream by using a bitstream decoder, wherein the decoded audio signal comprises at least one decoded frame;

producing a noise estimation signal comprising an estimation of a level and/or a spectral shape of a noise in the decoded audio signal by using a noise estimation device;

deriving a comfort noise signal from the noise estimation signal by using a comfort noise generating device;

combining the decoded frame of the decoded audio signal and the comfort noise signal in order to acquire an audio output signal by using a combiner; and feeding, by using a switch, either the decoded signal from the bitstream decoder or a decoded signal from a further bitstream decoder to the noise estimation device and to the combiner, wherein the bitstream decoder and the further bitstream decoder are of different types.

23. A method of audio signal encoding for producing an audio bitstream, wherein the method comprises:

determining a signal-to-noise ratio of an audio input signal based on a determined energy of a wanted signal of the audio input signal and a determined energy of a noise of the audio input signal;

producing an noise reduced audio signal;

producing an encoded audio signal corresponding to the audio input signal, wherein, depending on the determined signal-to-noise ratio of the audio input signal, either the audio input signal or the noise reduced audio signal is encoded;

deriving the bitstream from the encoded audio signal; and transmitting a side information, which indicates whether the audio input signal or the noise reduced audio signal is encoded, within the bitstream.

24. A bitstream produced according to the method of claim 23.

25. A non-transitory digital storage medium having a computer program stored thereon to perform the method of decoding an audio bitstream, wherein the method comprises:

deriving a decoded audio signal from the bitstream, wherein the decoded audio signal comprises at least one decoded frame by using a bitstream decoder;

producing a noise estimation signal comprising an estimation of the level and/or the spectral shape of a noise in the decoded audio signal by using a noise estimation device;

deriving a comfort noise signal from the noise estimation signal a comfort noise generating device;

combining the decoded frame of the decoded audio signal and the comfort noise signal in order to acquire an audio output signal by using a combiner; and feeding, by using a switch, either the decoded signal from the bitstream decoder or a decoded signal from a further bitstream decoder to the noise estimation device and to the combiner, wherein the bitstream decoder and the further bitstream decoder are of different types, when said computer program is run by a computer.

26. A non-transitory digital storage medium having a computer program stored thereon to perform the method of audio signal encoding for producing an audio bitstream, wherein the method comprises:

determining a signal-to-noise ratio of an audio input signal based on a determined energy of a wanted signal of the audio input signal and a determined energy of a noise of the audio input signal;

producing an noise reduced audio signal;

producing an encoded audio signal corresponding to the audio input signal, wherein, depending on the determined signal-to-noise ratio of the audio input signal, either the audio input signal or the noise reduced audio signal is encoded;

deriving the bitstream from the encoded audio signal; and transmitting a side information, which indicates whether the audio input signal or the noise reduced audio signal is encoded, within the bitstream, when said computer program is run by a computer.

* * * * *